US008413727B2

(12) United States Patent
Holmes

(10) Patent No.: US 8,413,727 B2
(45) Date of Patent: Apr. 9, 2013

(54) DISSOLVABLE DOWNHOLE TOOL, METHOD OF MAKING AND USING

(75) Inventor: Kevin C. Holmes, Houston, TX (US)

(73) Assignee: Bakers Hughes Incorporated, Houston, TX (US)

( * ) Notice: Subject to any disclaimer, the term of this patent is extended or adjusted under 35 U.S.C. 154(b) by 227 days.

(21) Appl. No.: 12/469,108

(22) Filed: May 20, 2009

(65) Prior Publication Data

US 2010/0294510 A1 Nov. 25, 2010

(51) Int. Cl.
*E21B 29/00* (2006.01)

(52) U.S. Cl.
USPC ..... 166/376

(58) Field of Classification Search ..... 166/376
See application file for complete search history.

(56) References Cited

U.S. PATENT DOCUMENTS 6,024,915 A * 2/2000 Kume et al. ..... 419/48
6,582,763 B1 * 6/2003 Nishimura et al. ..... 427/216
2004/0121073 A1 * 6/2004 George et al. ..... 427/215
2007/0181224 A1 * 8/2007 Marya et al. ..... 148/400
2008/0105438 A1 * 5/2008 Jordan et al. ..... 166/376

OTHER PUBLICATIONS

Swor, L., et al. "Self-removing Frangible Bridge and Fracture Plugs," SPE Annual Technical Conference and Exhibition, San Antonio, Texas, Sep. 24-27, 2006, Paper No. 102994-MS.
Larimore, David R., et al. "Overcoming Completion Challenges with Interventionless Devices—Case Histories of the Disappearing Plug," SPE Asia Pacific Oil and Gas Conference and Exhibition, Brisbane, Autralia, Oct. 16-18, 2000. Paper No. 64527-MS.
Todd, B., et al. "A Chemical "Trigger" Useful for Oilfield Applications," SPE International Symposium on Oilfield Chemistry, The Woodlands, Texas, Feb. 2-4, 2005. Paper No. 92709-MS.

* cited by examiner

*Primary Examiner* — Daniel P Stephenson
*Assistant Examiner* — Kipp Wallace
(74) *Attorney, Agent, or Firm* — Cantor Colburn LLP

(57) ABSTRACT

Disclosed herein is a dissolvable downhole tool. The tool includes, a dissolvable body constructed of at least two materials and at least one of the at least two materials is a reactive material, and a first material of the at least two materials being configured to substantially dissolve the dissolvable body and a second material configured to control reaction timing of the first material.

24 Claims, 5 Drawing Sheets

DISSOLVABLE DOWNHOLE TOOL, METHOD OF MAKING AND USING

BACKGROUND

In the subterranean drilling and completion industry there are times when a downhole tool located within a wellbore becomes an unwanted obstruction. Accordingly, downhole tools have been developed that can be deformed, by operator action, for example, such that the tool's presence becomes less burdensome. Although such tools work as intended, their presence, even in a deformed state can still be undesirable. Devices and methods to further remove the burden created by the presence of unnecessary downhole tools are therefore desirable in the art.

BRIEF DESCRIPTION

Disclosed herein is a dissolvable downhole tool. The tool includes, a dissolvable body constructed of at least two materials and at least one of the at least two materials is a reactive material, and a first material of the at least two materials being configured to substantially dissolve the dissolvable body and a second material configured to control reaction timing of the first material.

Further disclosed herein is a method of dissolving a downhole tool. The method includes, positioning the downhole tool fabricated of a first material and a second material within a wellbore, reacting the second material, exposing the first material to a downhole environment, reacting the first material with the downhole environment, and dissolving the downhole tool Further disclosed herein is a method of making a dissolvable downhole tool. The method includes, encasing particulates of a first reactive material with a second reactive material, and sintering the encased particulates to form the dissolvable downhole tool.

Further disclosed herein is a method of making a dissolvable downhole tool. The method includes, constructing a core of the dissolvable downhole tool with a first reactive material, and coating the core with a second reactive material, the second reactive material being significantly less reactive than the first reactive material.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
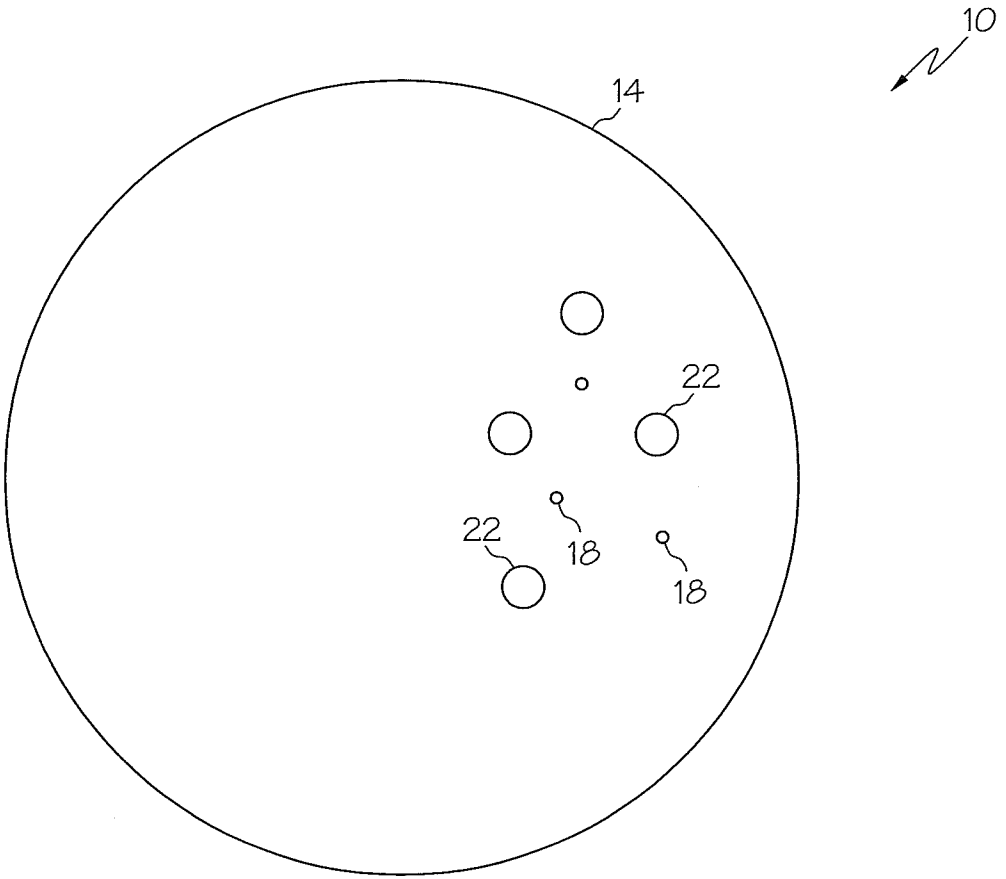
FIG. 1 depicts a cross-sectional view of an embodiment of a dissolvable downhole tool disclosed herein.

Referring to FIG. 1, a cross-sectional view of an embodiment of a dissolvable downhole tool, depicted in this embodiment as a tripping ball, is illustrated at 10. Alternate embodiments of the downhole tool include 10, ball seats and cement shoes, for example, as well as other tools whose continued downhole presence may become undesirable. The downhole tool 10 includes a body 14 constructed of at least two reactive materials with this particular embodiment disclosing specifically two reactive materials 18, 22. The first reactive material 18 being much more reactive than the second reactive material 22. These reactivities being defined when the reactive materials 18, 22 are in an environment wherein they are reactive (as will be described in detail below), such as may exist in a downhole environment, for example. The body 14 is configured by the reactive materials 18, 22 to cause the body 14 to dissolve in response to reaction of at least one of the reactive materials 18, 22. The reaction of the at least one reactive material 18, 22 causes dissociation and subsequent dissolving of the downhole tool 10. The dissolving of the downhole tool 10 removes any obstructive effects created by the presence of the downhole tool 10, as any remnants of the body 14 can simply be washed away.

The reactive materials 18, 22 can be selected and configured such that their reactivity is dependent upon environments to which they are exposed. As such, the reactive materials 18, 22 may be substantially non-reactive until they are positioned downhole and exposed to conditions typically found in a downhole wellbore environment. These conditions include reactants, such as typical wellbore fluids, oil, water, mud and natural gas, for example. Additional downhole conditions that may be reactive with or affect reactivity of the reactive materials 18, 22 alone or in combination with the wellbore fluids include, changes in temperature, changes in pressure, differences in acidity level and electrical potentials, for example. These reactions include but are not limited to oxidation and reduction reactions. These reactions may also include volumetric expansion that can add mechanical stress to aid and accelerate the dissolving of the body 14. Materials that can be reactive in the downhole environment and thus are appropriate choices for either or both of the reactive materials 18, 22 include, magnesium, aluminum, tin, tungsten, nickel, carbon steel, stainless steel and combinations of the aforementioned.

The reactive materials 18, 22 are configured in the body 14 to control a rate at which the first reactive material 18 (the more reactive of the two reactive materials) reacts thereby also controlling the rate at which the body 14 dissolves. This is in part due to the significant difference in reactivity between the first reactive material 18 and the second reactive material 22. This difference is so significant that a rate of reaction of the first material 18 may be insignificant in comparison to a rate of reaction of the second reactive material 22. This relationship can allow an operator to substantially control the time from first exposure of the downhole tool 10 to a reactive environment until completion of dissolving of the body 14 with primarily just the second reactive material 22. As such, the reactive materials 18, 22 can be configured in relation to one another in various ways, as will be discussed below, to assure the time to dissolve is controlled primarily by the second reactive material 22.

Figure 2:
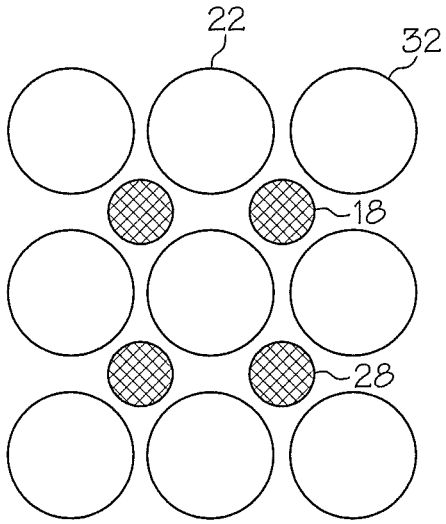
FIG. 2 depicts a magnified partial cross-sectional view of a structure of the dissolvable downhole tool of FIG. 1 in a green state.
Figure 3:
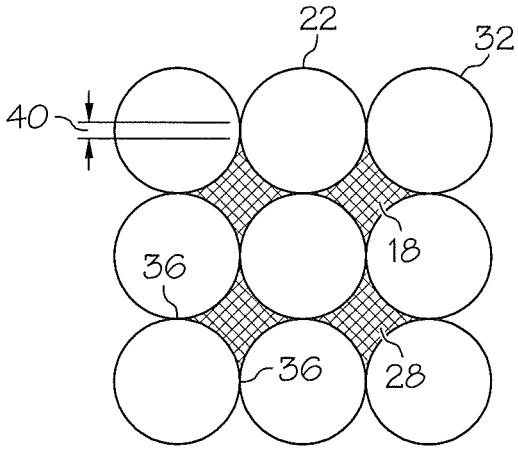
FIG. 3 depicts a magnified partial cross-sectional view of the structure of the dissolvable downhole tool of FIG. 1 in a forged state.

Referring to FIGS. 2 and 3, the reactive materials 18, 22, as illustrated, are configured in this embodiment such that the time to dissolve is controlled by the second reactive material 22. Sinterable first particles 28 of the first reactive material 18, and sinterable second particles 32 of the second reactive material 22 are shown in FIG. 2 in a green state and in FIG. 3 in a forged state. The green state being defined as after the particles 28, 32 are thoroughly mixed and pressed into the shape of the body 14, but prior to sintering. The forged state is after sintering and at a point where fabrication of the downhole tool 10 is complete. In the forged state the first particles 28 are sealed from direct exposure to the downhole environment by sealing of adjacent second particles 32 to one another, including interstitial webbing 36 formed during the sintering process. This sealing of the first particles 28 prevents their reacting. A thickness 40 of the interstitial webbing 36 is the thinnest and weakest portion of the seal created by the sintering of the second particles 32. As such, a leak path through the seal will likely occur first at the interstitial webbing 36 in response to reaction and subsequent degradation of the second material 22. Through control of the sintering process the thickness 40 of the interstitial webbing 36 can be accurately controlled. Such control allows an operator to forecast the time needed to degrade the interstitial webbing 36 to the point that the first particles 28 begin to be exposed to the downhole environment and begin to react. Once the first particles 28 begin to react the additional time needed for the body 14 to dissolve is short.

The body 14 can be configured such that once reaction of the first particles 28 has begun reaction of other nearby first particles 28 can be accelerated creating a chain reaction that quickly results in dissolving of the body 14. This acceleration can be due to newly reactive chemicals that are released by reactions of the first reactive material 18, or by heat given off during reaction of the first particles 28, in the case of an exothermic reaction, or by volumetric expansion of the reaction that mechanically opens new pathways to expose new first particles 28 to the downhole environment.

In an alternate embodiment, reactivity of the second reactive material 22 can be so slow as to be considered fully non-reactive. In such an embodiment the reaction rate of the first reactive material 18 is controlled, not by the reaction rate of the second reactive material 22 (since the second reactive material is does not react) but instead by sizes of interstitial openings (not shown but would be in place of the interstitial webbing 36 of the previous embodiment) between adjacent sintered second particles 32 of the second reactive material 22. The small size of the interstitial openings limits the exposure of the first particles 28 of the first reactive material 18 that controls a reaction rate of the first reactive material 18.

Figure 4:
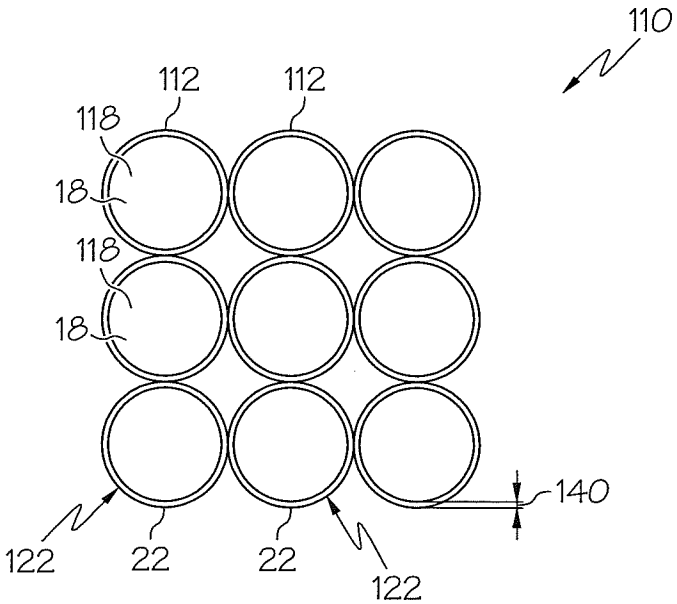
FIG. 4 depicts a magnified partial cross-sectional view of a structure of an alternate embodiment disclosed herein in a forged state.

Referring to FIG. 4, an alternate embodiment of a sintered structure 110 is illustrated. The sintered structure 110 includes sintered particles 112 having an inner core 118 made of the first reactive material 18 and a shell 122 made of the second reactive material 22. In this embodiment, the first reactive material 18 is sealed from the downhole environment by the shell 122 made of the second reactive material 22. Degradation of the shell 122 in response to reaction of the second reactive material 22 causes a breach of the shell 122 and results in exposure of the first reactive material 18 to the downhole environment. All other things being equal, control of a thickness 140 of the shell 122 can determine the time from initial exposure of the tool 10 to the downhole environment until initiation of exposure, and subsequent reaction of the first reactive material 18, and consequently the time for dissolving of the downhole tool 10.

Figure 6:
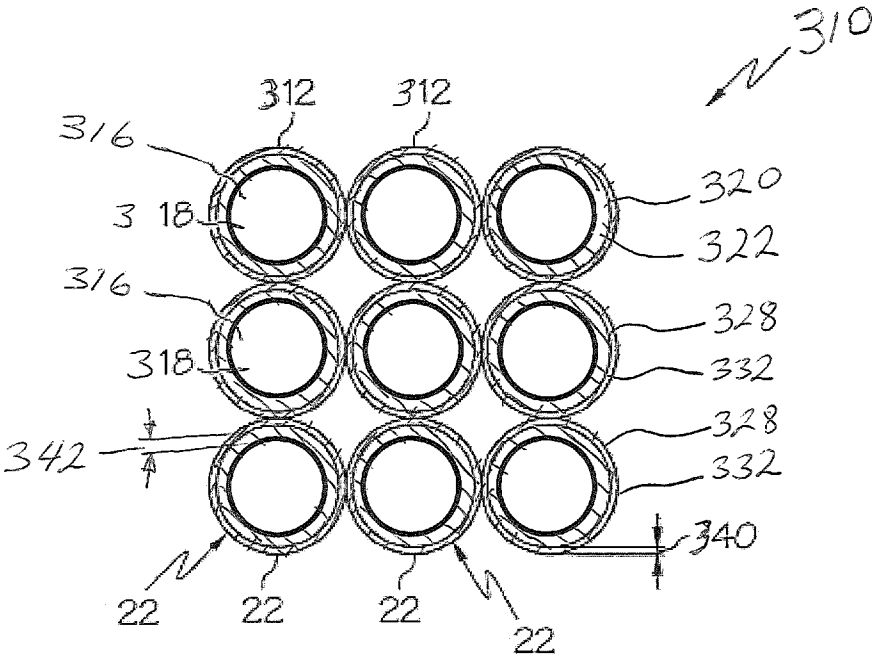
FIG. 6 depicts a magnified partial cross-sectional view of a structure of an alternate embodiment disclosed herein in a forged state.

Referring to FIG. 6, an alternate embodiment of a sintered structure 310 is illustrated. The sintered structure 310 includes sintered particles 312 having an inner core 316 made of the first reactive material 318 and a first shell 320 made of a second reactive material 322 and a second shell 328 made of a third reactive material 332. In this embodiment, the first reactive material 318 is sealed from the downhole environment by the first shell 320 made of the second reactive material 322 and the second reactive material 322 is sealed from the downhole environment by the second shell 328 made of the third reactive material 332. Degradation of the second shell 328 in response to reaction of the third reactive material 332 causes a breach of the second shell 328 and results in exposure of the second reactive material 322 to the downhole environment. Subsequent to the degradation of the second shell degradation of the first shell 320, initiated in response to reaction of the second reactive material 322, causes a breach of the first shell 320 and results in exposure of the first reactive material 318 to the downhole environment. All other things being equal, control of thicknesses 340, 342 of the second shell 328 and the first shell 320 respectively can determine the time from initial exposure of the tool 10 to the downhole environment until dissolution of the downhole tool 10.

Alternate embodiments of structures contemplated but not specifically illustrated herein include, sintering mixtures of particles with some particles having multiple reactive materials, such as the sintered particles 112, and some having just one reactive material such as the first particles 28 or the second particles 32. Still other embodiments may include particles having two or more shells of reactive materials with each additional shell being positioned radially outwardly of the previous shell.

Figure 5:
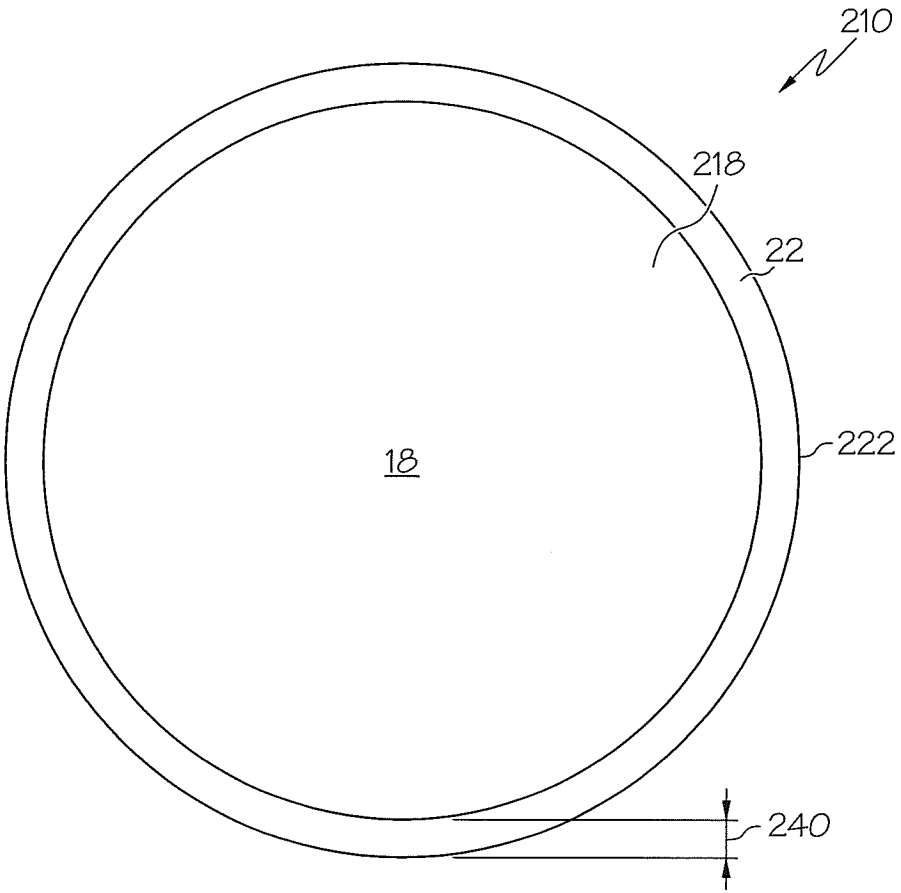
FIG. 5 depicts a cross-sectional view of an alternate embodiment of a dissolvable downhole tool disclosed herein.

Referring to FIG. 5, another embodiment of a dissolvable downhole tool, depicted herein as a tripping ball, is illustrated at 210. The downhole tool 210 includes, an inner portion 218, made of the first reactive material 18 and a shell 222 made of the second reactive material 22. The shell 222 sealingly encases the inner portion 218 thereby occluding direct contact between the first reactive material 18 and the downhole environment. The shell 222 is configured to react with the downhole environment thereby degrading the shell 222 resulting in exposure the first reactive material 18 of the inner portion 218 directly to the downhole environment, and subsequent reaction therewith. Similar to the process described above, in reference to the downhole tool 10, reaction of the first reactive material 18 causes the dissolvable downhole tool 210 to dissolve.

Several parameters of the downhole tool 210 can be selected to control the rate of reaction of the second reactive material 22 and ultimately the exposure of the first reactive material 18 and the full dissolving of the downhole tool 210. For example, the chemical make up of the second reactive material 22, an amount of alloying of the second reactive materials 22 with other less reactive or non-reactive materials, density, and porosity. As described above a thickness 240 of the shell 222 can be established to control a time lapse after exposure to a reactive environment until a breach of the shell 222 exposes the first reactive material 18 to the reactive environment. Additionally, an electrolytic cell between either the first reactive material 18 and the second reactive material 22 or between at least one of the reactive materials 18, 22 and another downhole component can be established to create an anodic reaction to effect the reaction rate and the associated time to dissolve the downhole tool 210.

The aforementioned parameters can be selected for specific applications such that the reaction is estimated to result in the downhole tool 10, 210 dissolving within a specific period of time such as within two to seven days of being positioned downhole, for example. Such knowledge allows a well operator to utilize the downhole tool 10, 210 for a specific purpose and specific period of time while not having to be burdened by the presence of the tool 10, 210 after usefulness of the downhole tool 10, 210 has expired.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A dissolvable downhole tool, comprising a dissolvable body comprising a plurality of encased particles sintered together, the plurality of encased particles being constructed of at least two materials with at least one of the at least two materials being a reactive material, a first material of the at least two materials being configured to substantially dissolve the dissolvable body downhole and a second material configured to control reaction timing of the first material, the first material and the second material being selected to promote oxidation or reduction reactions when they react the first material being encased in the second material and the second material being encased in a third material before being sintered.

2. The dissolvable downhole tool of claim 1, wherein reaction of a relatively small amount of the first material accelerates reaction of the remaining first material.

3. The dissolvable downhole tool of claim 1, wherein at least one of the second material and the third material is a reactive material.

4. The dissolvable downhole tool of claim 1, wherein a difference in reactivity between the first material and the second material is such that the total time required to dissolve the dissolvable downhole tool is substantially controlled by reactivity of the second material.

5. The dissolvable downhole tool of claim 1, wherein the plurality of particulates are cores of the first material that are encased in shells of the second material that are encased in shells of the third material.

6. The dissolvable downhole tool of claim 1, wherein reaction of the third material exposes the second material to a downhole environment and reaction of the second material exposes the first material to a downhole environment.

7. The dissolvable downhole tool of claim 1, wherein reaction of the third materials exposes the second material to wellbore fluids and reaction of the second material exposes the first material to wellbore fluids.

8. The dissolvable downhole tool of claim 1, wherein control of reaction timing of the second material is proportional to a thickness of a shell of the third material encasing the second material and control of reaction timing of the first material is proportional to a thickness of a shell of the second material encasing the first material.

9. The dissolvable downhole tool of claim 1, wherein reactions of at least one of the first material and the second material includes an anodic reaction.

10. The dissolvable downhole tool of claim 1, wherein the first material is highly reactive with a wellbore fluid.

11. The dissolvable downhole tool of claim 1, wherein the first material is highly reactive with fluids selected from the group consisting of mud, oil, water, natural gas and combinations of the aforementioned.

12. The dissolvable downhole tool of claim 1, wherein at least one of the first material and the second material reacts exothermically.

13. The dissolvable downhole tool of claim 1, wherein at least one of the first material, the second material and the third material are selected from the group consisting of magnesium, aluminum, tin, tungsten, nickel, carbon steel, stainless steel and combinations of the aforementioned.

14. The dissolvable downhole tool of claim 1, wherein at least one of the first material and the second material are alloyed and the resultant alloy controls a reaction rate.

15. The dissolvable downhole tool of claim 1, wherein a structure of the first material with the second material controls a rate of reaction of the first material.

16. The dissolvable downhole tool of claim 1, wherein reactivity of at least one of the first material and the second material is aided by addition of at least one selected from the group consisting of changes in temperature, changes in pressure, differences in acidity level and electrical potential.

17. The dissolvable downhole tool of claim 1, wherein a rate of reaction of at least one of the first material, the second material and the third material is altered by one selected from the group consisting of thickness, porosity, density and combinations of two or more of the aforementioned.

18. The dissolvable downhole tool of claim 1, wherein the dissolvable downhole tool is a ball.

19. The dissolvable downhole tool of claim 1, wherein reaction of at least one of the first material and the second material includes expansion.

20. The dissolvable downhole tool of claim 1, wherein the dissolvable body is configured to dissolve within seven days of being positioned within a wellbore.

21. A method of dissolving a downhole tool, comprising positioning the downhole tool fabricated of a plurality of particles sintered together, the plurality of particles having cores made of a first material and a first shell made of a second material and a second shell made of a third material prior to sintering, within a wellbore;

reacting the third material;

exposing the second material to a downhole environment;

reacting the second material;

exposing the first material to a downhole environment;

reacting the first material with the downhole environment; and dissolving the downhole tool.

22. The method of dissolving the downhole tool of claim 21, wherein the reacting of at least one of the first material and the second material includes releasing heat.

23. The method of dissolving the downhole tool of claim 21, wherein the reacting of at least one of the first material and the second material includes expanding.

24. A method of making a dissolvable downhole tool, comprising:

encasing particulates of a first dissolvable material with a second reactive material such that they promote oxidation or reduction reactions when they react;

encasing the encased particulates with a third reactive material; and sintering the encased particulates to form the dissolvable downhole tool.

* * * * *